US005100539A

United States Patent [19]

Tsutsumi

[11] Patent Number: 5,100,539

[45] Date of Patent: Mar. 31, 1992

[54] DUAL-SCREEN PARTICLE SIZING APPARATUS AND METHOD

[75] Inventor: Masataka Tsutsumi, Canton, Ohio

[73] Assignee: Sizetec, Inc., Canton, Ohio

[21] Appl. No.: 458,307

[22] Filed: Dec. 28, 1989

Related U.S. Application Data

[63] Continuation-in-part of Ser. No. 430,775, Nov. 2, 1989, abandoned.

[51] Int. Cl.[5] ..... B07B 1/30; B07B 1/34; B07B 1/36; B07B 1/42

[52] U.S. Cl. ..... 209/240; 209/243; 209/311; 209/329; 209/341; 209/346; 209/365.1; 209/413

[58] Field of Search ..... 209/240, 241, 243, 244, 209/254, 255, 257, 311, 313, 325, 326, 329, 341, 365.1, 366, 366.5, 409, 412, 413, 415, 346

[56] References Cited

U.S. PATENT DOCUMENTS

| | | | |
|---|---|---|---|
| 419,113 | 1/1890 | Coxe et al. | 209/313 X |
| 2,053,895 | 9/1936 | Burmeister | 209/326 |
| 2,628,718 | 2/1953 | Dockins | 209/254 X |
| 2,819,796 | 1/1958 | Edwards | 209/319 |
| 3,666,095 | 5/1972 | Krynock et al. | 209/326 X |
| 3,703,236 | 11/1972 | Spurlin et al. | 209/326 |
| 4,062,768 | 12/1977 | Elliott . | |
| 4,082,657 | 4/1978 | Gage | 209/311 |
| 4,107,035 | 8/1978 | Foresman | 209/315 X |
| 4,351,719 | 9/1982 | Morey | 209/244 X |
| 4,482,455 | 11/1984 | Humphrey | 209/329 X |
| 4,576,713 | 3/1986 | Melin | 209/254 |
| 4,906,356 | 3/1990 | Musschoot | 209/254 X |

FOREIGN PATENT DOCUMENTS

| | | | |
|---|---|---|---|
| 0155180 | 9/1985 | European Pat. Off. . | |
| 0609277 | 3/1935 | Fed. Rep. of Germany | 209/244 |
| 2749592 | 5/1979 | Fed. Rep. of Germany . | |
| 3043497 | 6/1982 | Fed. Rep. of Germany . | |
| 3109319 | 9/1982 | Fed. Rep. of Germany . | |
| 1300968 | 7/1962 | France | 209/315 |
| 0556694 | 12/1974 | Switzerland | 209/413 |
| 1025462 | 6/1983 | U.S.S.R. | 209/325 |
| 2048723 | 12/1980 | United Kingdom . | |
| 2078554 | 1/1982 | United Kingdom | 209/325 |
| WO89/08501 | 9/1989 | World Int. Prop. O. . | |

*Primary Examiner*—Michael S. Huppert
*Assistant Examiner*—Edward M. Wacyra
*Attorney, Agent, or Firm*—Daniel J. Hudak Co.

[57] ABSTRACT

An apparatus and method for sizing and separating particles of a material. The apparatus includes a stand, a frame having a pair of ends and an intermediate portion, and suspension assemblies attached to the stand and the frame for movably suspending the frame on the stand. A pair of inclined screens are removably mounted in a pair of screen boxes removably mounted on the frame, with each of the screens sloping downwardly from the intermediate portion of the frame toward a respective one of the ends of the frame. At least one motor is mounted on the frame for vibrating the frame and attached screens, and a feed box is mounted on the stand adjacent to and above upper ends of the screens for supplying a material to be sized. The method of the invention includes the steps of actuating the motor and depositing a material onto the upper ends of the screens via the feed box, so that the vibrating screens can simultaneously size and separate particles of the material. Spacers can be inserted between the stand and certain ones of the suspension assemblies to effect small changes in the slope of the screens, if needed, for generally equalizing the rate of movement of a material on each of the screens. The screen boxes can be replaced to effect gross changes in the slope of the screens, so that the apparatus can be used in different particle sizing applications.

30 Claims, 5 Drawing Sheets

FIG. 2
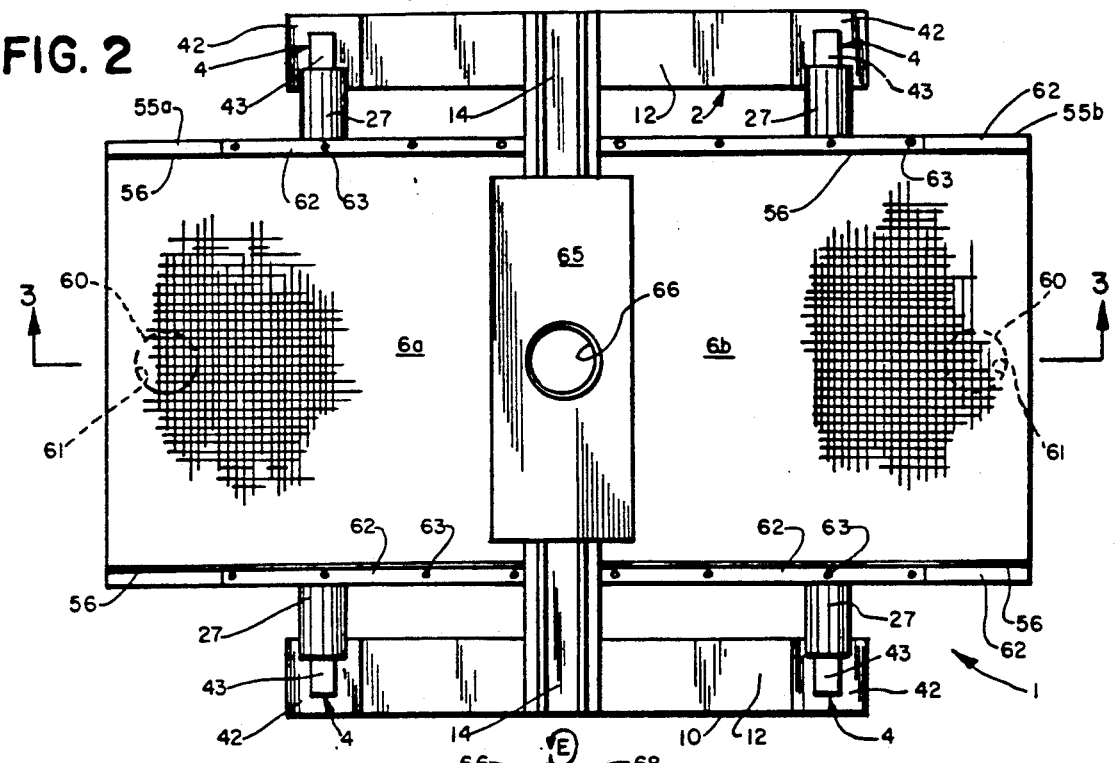
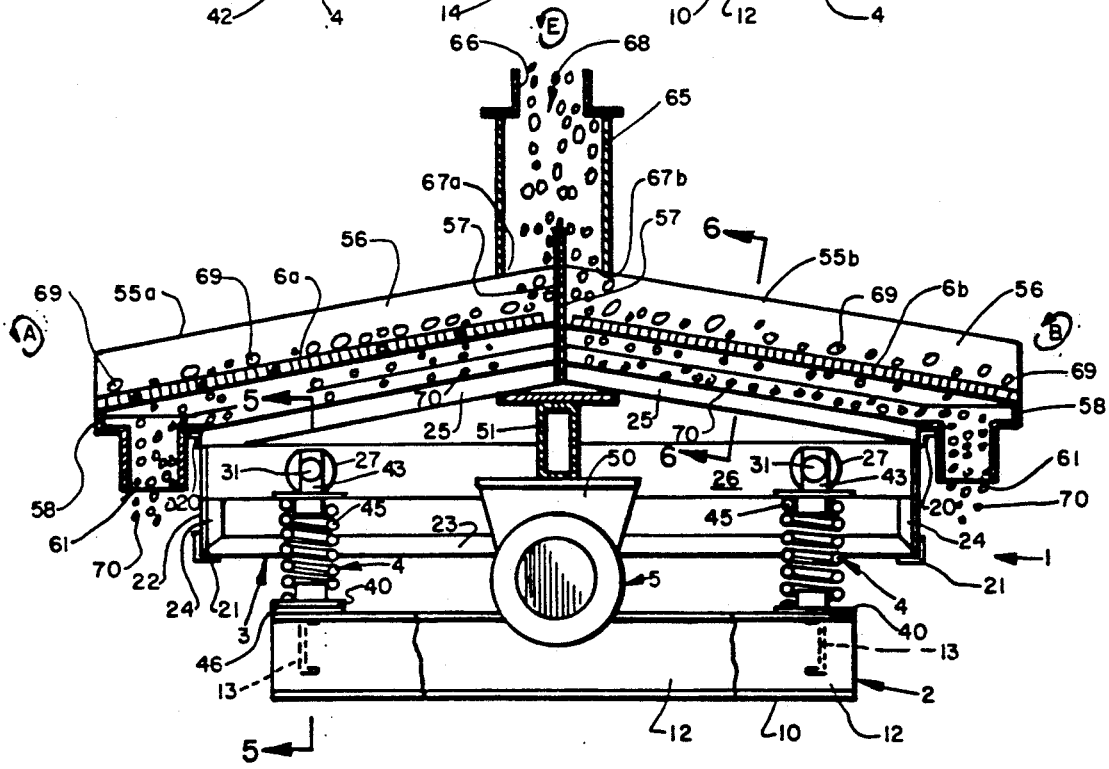
FIG. 3

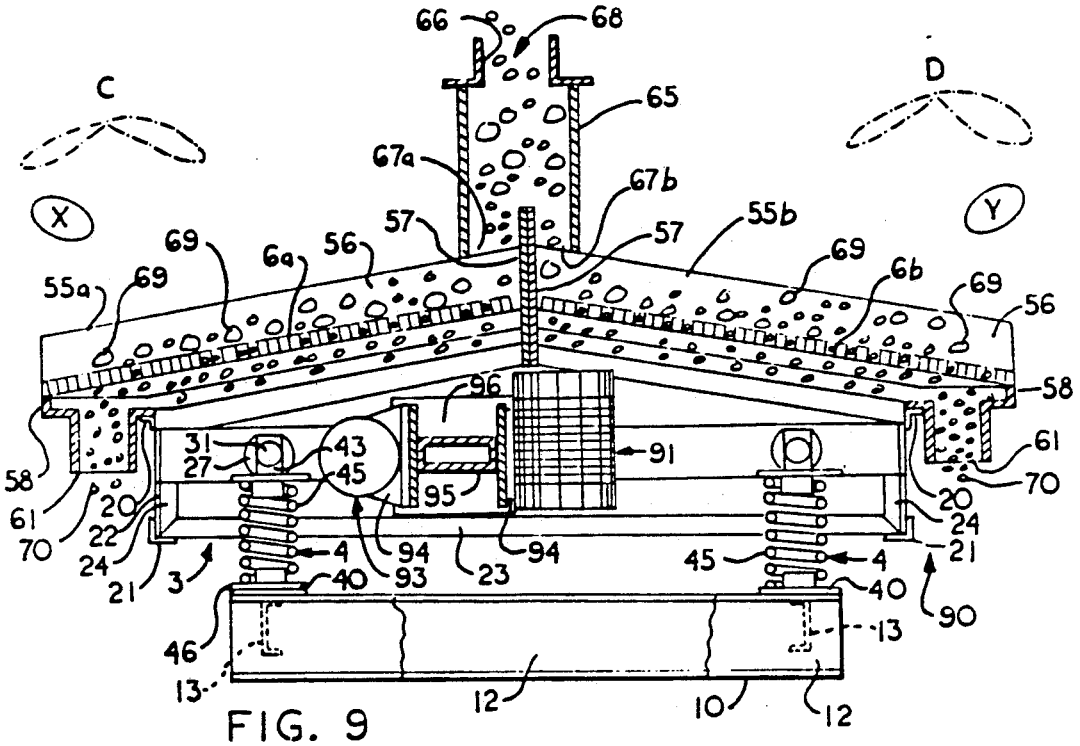
FIG. 9
FIG. 10
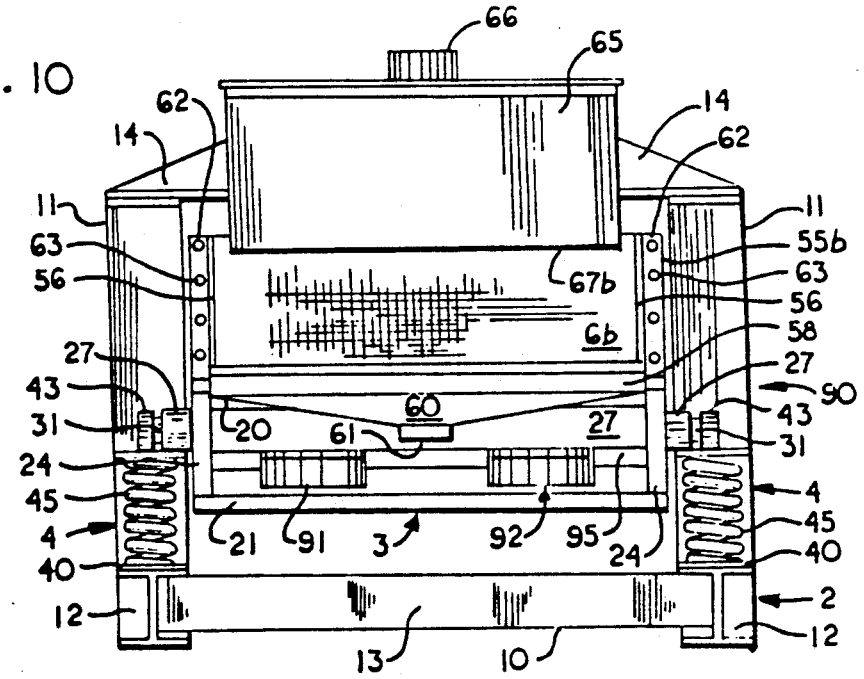

DUAL-SCREEN PARTICLE SIZING APPARATUS AND METHOD

CROSS-REFERENCE TO RELATED APPLICATIONS

This application is a continuation-in-part of pending application Ser. No. 07/430,775, filed on Nov. 2, 1989, now abandoned.

BACKGROUND OF THE INVENTION

1. Technical Field

The invention relates to screen apparatus and methods for sizing particles of a material, and in particular to an apparatus and method which sizes and separates particles of a material by motorized vibration of an inclined screen. More particularly, the invention relates to such an apparatus and method for sizing and separating particles of a material which utilizes motorized vibration of a pair of inclined screens to achieve increased particle sizing efficiency.

2. Background Information

Sizing equipment is commonly used in a variety of industrial processes including mineral processing of coal, kaolin, bauxite, taconite, gold, phosphate, potash, and silica sand, as well as in chemical processing, pulp and paper processing, food processing, waste water and sewage treatment, and oil well drilling fluid cleaning. Equipment of the type intended for sizing and separating particles of a material usually includes a stand, a frame movably suspended on the stand, an inclined elongated screen of usually approximately eight feet mounted on the frame, and one or more motors mounted on the frame for vibrating the frame and attached screen. A material is deposited on the upper end of the inclined vibrating screen, which sizes and separates particles of the material as it moves down the screen.

Although such sizing apparatus perform their intended functions well, it has become apparent in many applications that a screen having a length of eight feet is excessive, since substantially complete particle sizing and separation of a particular material often is accomplished by the time the material has traveled only halfway down the elongated screen. Thus, in many applications the use of sizing apparatus having such an elongated screen is unnecessary.

Therefore, the need exists for an improved apparatus and method for sizing and separating particles of a material, which achieves increased particle sizing efficiency.

SUMMARY OF THE INVENTION

Objectives of the present invention include providing a dual-screen particle sizing apparatus and method which increases the efficiency of particle sizing and separating operations.

Another objective of the invention is to provide such a dual-screen particle sizing apparatus and method in which gross changes in the slope of the screens can be effected for use of the apparatus in many different particle sizing applications.

A further objective of the invention is to provide such a dual-screen particle sizing apparatus and method in which small changes in the slope of the screens can be effected for generally equalizing the rate of movement of a material on each of the screens.

Still another objective of the invention is to provide such a dual-screen particle sizing apparatus and method in which one or more motors, depending on the application, provides the necessary vibrating motion to the pair of screens for efficient particle sizing and separation of a material.

A still further objective of the invention is to provide such a dual-screen particle sizing apparatus and method in which water spray equipment and techniques can be used in combination with the apparatus and method of the invention, if necessary.

Another objective of the invention is to provide such a dual-screen particle sizing apparatus and method in which the screens can be quickly and easily replaced due to wear, or the need for a different mesh screen for use in another application.

A further objective of the invention is to provide such a dual-screen particle sizing apparatus and method which is durable in use, and relatively inexpensive to manufacture, operate and maintain.

These objectives and advantages are obtained by the apparatus for sizing and separating particles of a material, the general nature of which may be stated as including, a stand, a frame, means attached to the stand and the frame for movably suspending the frame on the stand, motor means mounted on the frame for vibrating the frame, and a pair of inclined screens mounted on the frame, so that upon actuating the motor means and supplying a material onto upper ends of the screens, the vibrating frame vibrates the attached screens which size and separate particles of the material.

These objectives and advantages are further obtained by the method of sizing and separating particles of a material, using an apparatus comprising a stand, a frame having a pair of ends and an intermediate portion, suspension means attached to the stand and the frame for movably suspending the frame on the stand, motor means mounted on the frame for vibrating the frame, and a pair of inclined screens mounted on the frame, the screens each sloping downwardly from the intermediate portion of the frame toward a respective one of the ends of the frame, the general nature of which may be stated as including the steps of, actuating the motor means, vibrating the frame and attached screens with a vibrating motion transmitted to the frame by the motor means, supplying a material onto upper ends of the vibrating screens, sizing and separating particles of the material as the particles move along the screens toward the ends of the frame, and adjusting the slope of the screens for generally equalizing the rate of movement of a material on each of the screens.

BRIEF DESCRIPTION OF THE DRAWINGS

Preferred embodiments of the invention, illustrative of the best modes in which applicant has contemplated applying the principles, are set forth in the following description and are shown in the drawings and are particularly and distinctly pointed out and set forth in the appended claims.

FIG. 2 is a top plan view of the dual-screen particle sizing apparatus of FIG. 1;

FIG. 3 is a sectional view taken on line 3—3, FIG. 2, with portions broken away, showing the single motor of the first embodiment of the dual-screen apparatus and the particles of a material being sized and separated by the apparatus;

FIG. 9 is a sectional view similar to FIG. 3, with portions broken away, showing a third embodiment of the particle sizing apparatus of the invention having three motors; and FIG. 10 is an elevational end view of the third embodiment shown in FIG. 9.

Similar numerals refer to similar parts throughout the drawings.

DESCRIPTION OF THE PREFERRED EMBODIMENTS

Figure 1:
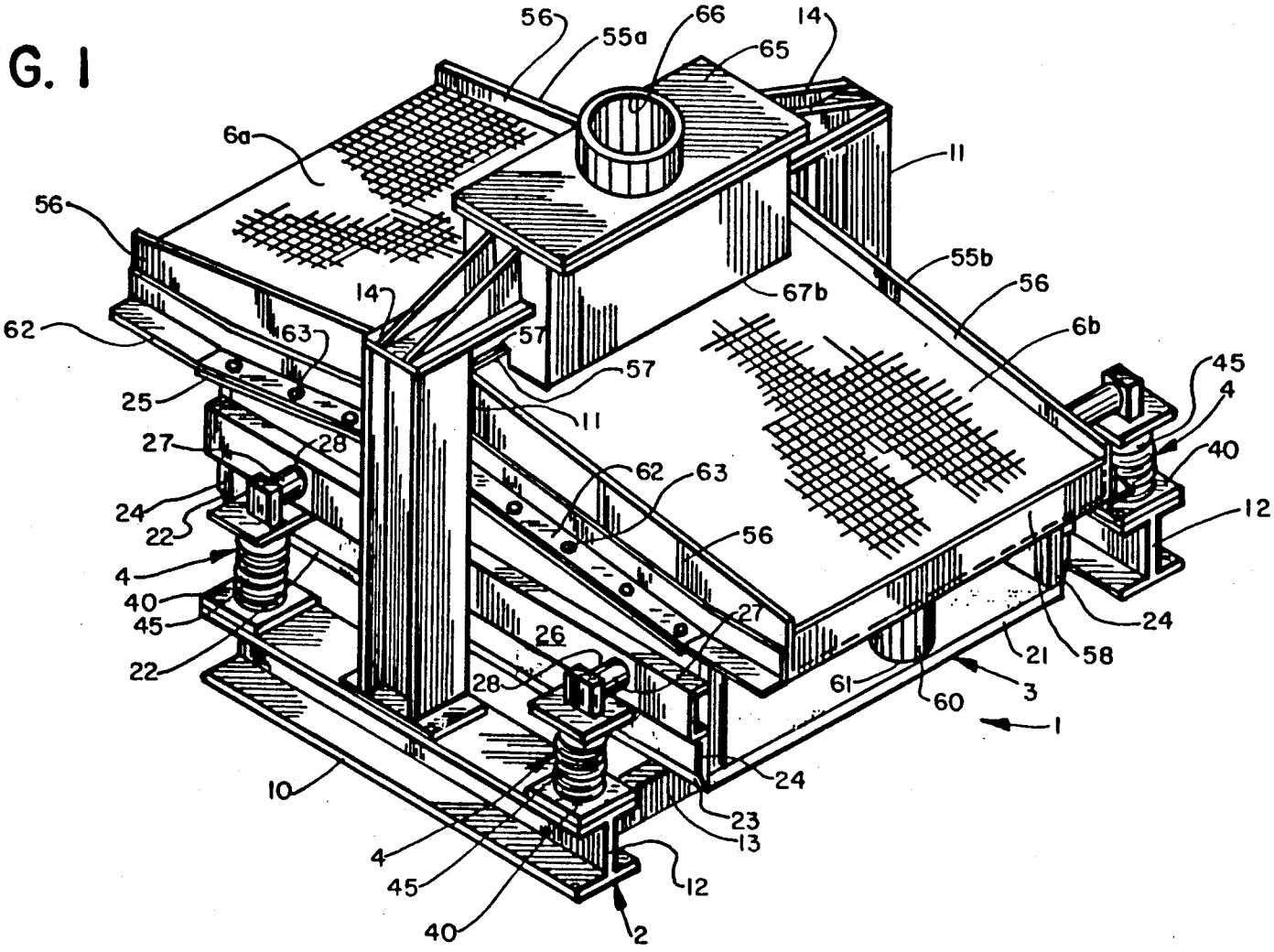
FIG. 1 is a perspective view of a first embodiment of the dual-screen particle sizing apparatus of the present invention.

A first embodiment of the improved dual-screen particle sizing apparatus of the present invention is indicated generally at 1, and is shown in FIGS. 1–4. Sizing apparatus 1 comprises a stand indicated generally at 2, a frame indicated generally at 3, a plurality of suspension assemblies each indicated generally at 4, a vibrator motor indicated generally at 5, and a pair of screens collectively referred to as 6 and individually as 6*a* and 6*b*. Stand 2 comprises a generally rectangular-shaped base portion 10 and a pair of upright pillar beams 11. Base portion 10 includes a pair of spaced, parallel, elongated side I-beams 12, and a pair of spaced, parallel, elongated end channel beams 13 which extend between and are connected to the ends of I-beams 12 to form a sturdy base portion 10. Pillar beams 11 are mounted on the intermediate portion of I-beams 12 in a spaced parallel relationship. A pair of opposed brackets 14 are mounted on the top ends of pillar beams 11 and extend inwardly therefrom.

Figure 4:
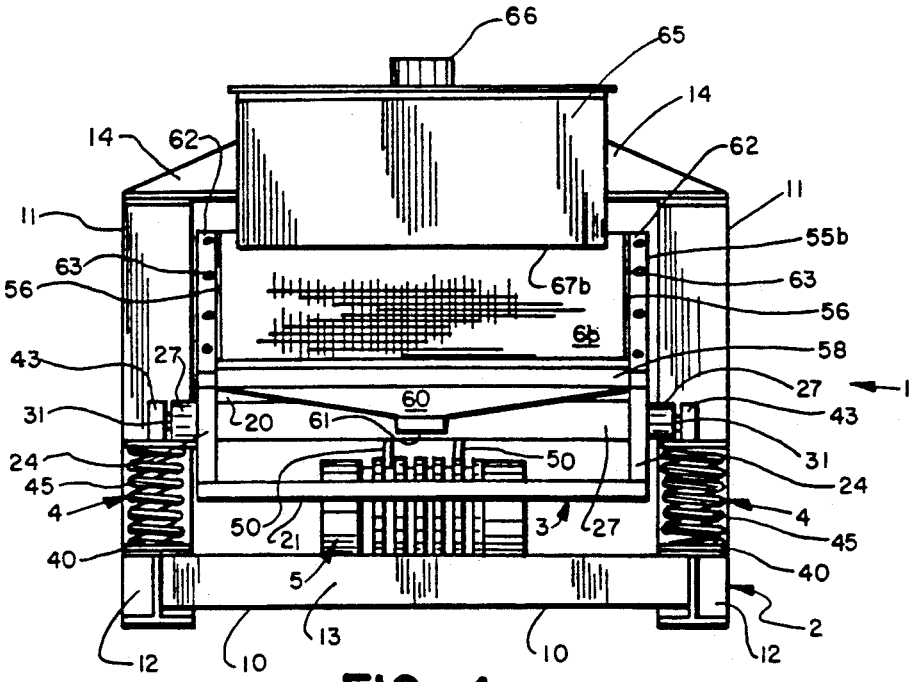
FIG. 4 is an elevational end view of the particle sizing apparatus of FIGS. 1—3.

Frame 3 is generally rectangular-shaped and includes a pair of side support assemblies 22 (FIGS. 1 and 3–4). Each side support assembly 22 (FIG. 3) comprises a horizontal bottom angle iron 23, a pair of upright angle irons 24 which are attached to the ends of bottom angle iron 23, and a pair of inclined top angle irons 25 which are attached at one of their ends to and extend upwardly from the top end of upright angle irons 24 and are attached to each other at their other end. Pairs of spaced, parallel, elongated upper and lower end angle irons 20 and 21, respectively, extend between and are connected to the ends of side support assemblies 22 to form a sturdy frame 3. A pair of spaced, parallel, elongated side channel support beams 26 extend between and are connected to upright angle irons 24 of side support assemblies 22. A pair of transverse suspension pipes 27 (FIGS. 2, 4 and 5) extend between and are mounted in aligned pairs of openings 28 and 32 formed in the ends of side channel support beams 26 and in attached support plates 33, respectively. An end cap 29 formed with a central opening 30 is mounted within each end of suspension pipes 27. An axle 31 is mounted within opening 30 of each end cap 29 and extends outwardly therefrom.

Figure 5:
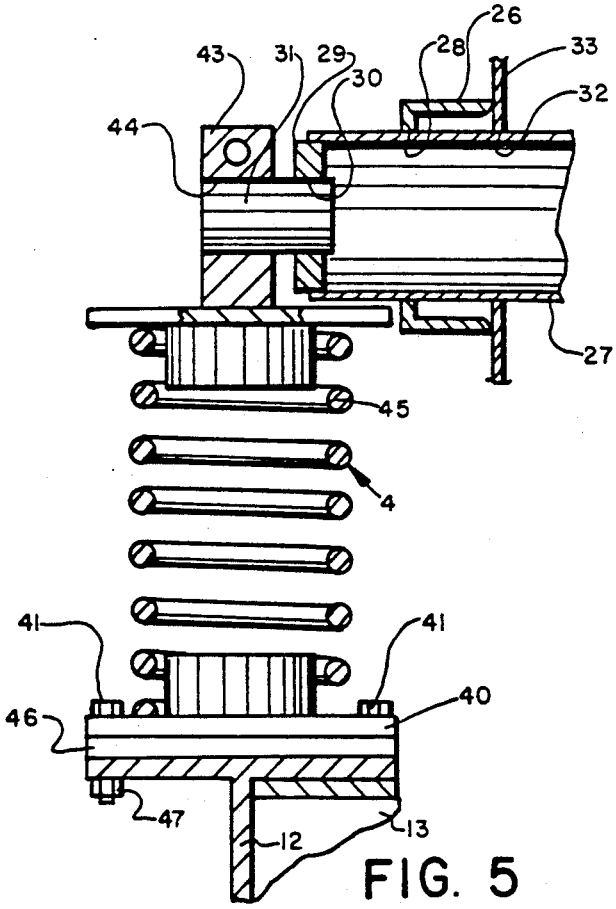
FIG. 5 is a greatly enlarged fragmentary sectional view taken on line 5—5, FIG. 3, particularly showing one of the suspension assemblies of the apparatus.

Frame 3 is movably suspended on stand 2 by the plurality of suspension assemblies 4 (FIGS. 1–4). More specifically, each assembly 4 includes a bottom spring pad 40 which are removably mounted on each end of side I-beams 12 of stand 2 by bolts 41 and nuts 47 (FIG. 5). A top spring pad 42 is mounted on the outer end of each axle 31 and is vertically aligned with its respective bottom spring pad 40. More particularly, each top spring pad 42 is formed with a vertically extending axle block 43. A horizontal opening 44 is formed in axle block 43 for receiving the outer end of axle 31 to mount top spring pad 42 on the axle. A usual coil spring 45 is removably captured between each aligned pair of top and bottom spring pads 42 and 40 for securely movably suspending frame 3 on stand 2.

In accordance with one of the features of the present invention, a pair of spacer plates 46 (FIGS. 3 and 5) can be inserted between a certain pair of the bottom spring pads 40 and side I-beams 12 of stand 2, for slight adjustment of the slope of inclined angle irons 25 of frame 2, as will be described in detail below in the description of the operation of sizing apparatus 1.

Motor 5 is mounted on a pair of motor base members 50, which in turn are mounted on and depend from a transverse channel member 51 which extends between and is connected to inclined angle irons 25 of frame 2, so that the shaft of the motor is positioned horizontally, and extends transversely with respect to frame 3 (FIGS. 3 and 4). Motor 5 is of the type which is well-known in the sizing equipment art, and transmits a high frequency, high gravitational force, generally vertical elliptical vibrating motion to frame 2 through motor base members 50 and channel member 51. An example of a suitable motor 5 which could be used with dual-screen sizing apparatus 1 is the rotary electric vibrator motor manufactured by Bulk Equipment Systems Technology, Inc. of Cleveland, Ohio, and identified as Model BE-11440-4.

Figure 6:
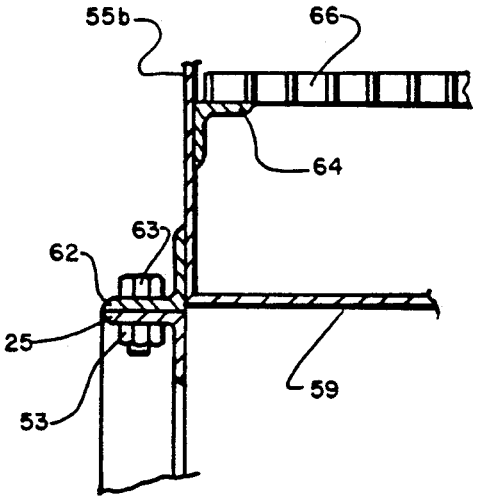
FIG. 6 is a greatly enlarged fragmentary sectional view taken on line 6—6, FIG. 3, particularly showing the manner in which one of the screens of the particle sizing apparatus of the invention is removably mounted.

In accordance with another of the features of the present invention, a pair of screen boxes, hereinafter collectively referred to as 55 and individually as 55*a* and 55*b*, are removably mounted on frame 3 (FIGS. 1–4). Since screen boxes 55*a* and 55*b* are similar, only the construction of screen box 55*a* is described herein. Screen box 55*a* includes a pair of spaced, parallel, elongated side walls 56, a pair of spaced, parallel, elongated upper and lower end walls 57 and 58, respectively, which extend between and are connected to the ends of side walls 56, and a bottom catch tray 59 which extends between and is connected to the lower end of the side walls and end walls. Catch tray 59 is formed with a chute 60 in its lower end which terminates in an outlet opening 61. An elongated angle iron 62 is attached to the outer surface of each side wall 56 of screen box 55*a*, and is removably attached to inclined angle irons 25 of frame 3 by bolts 63 and nuts 53 (FIG. 6) for securely removably mounting screen box 55*a* on the frame.

In accordance with one of the main features of the invention, a pair of screens 6 preferably each being approximately four feet in length and having a width of four feet, are incorporated in apparatus 1 (FIGS. 1–4). Screens 6 generally are within the range of 4 mesh and 500 mesh and preferably are suitable for both wet and dry sizing operations. This is in contrast to most prior art sizing equipment having single eight foot by four foot long screens. It has been discovered that most separation of a material will occur within the first four feet of its movement on a vibrating screen. Thus, two four foot long screens as opposed to one eight foot long screen as found in the prior art, approximately doubles the output of a sizing apparatus. Screens 6a and 6b are removably mounted in screen boxes 55a and 55b, respectively. More specifically, the screens are supported within boxes 55 by a plurality of spaced, inwardly extending brackets 64 (FIG. 6) which are attached to the inside surface of side walls 56 and end walls 57-58 of the boxes. Screens 6 preferably are pretensioned framed screens, although adjustable tension hook strip screens can be used if desired without effecting the concept of the invention.

A material feed box 65 having an inlet opening 66 and a pair of outlet openings, hereinafter collectively referred to as 67 and individually as 67a and 67b, is mounted adjacent to and above the upper end of screen boxes 55a and 55b, respectively, by attachment to inwardly extending stand brackets 14 (FIGS. 1-4).

The improved method of the present invention for sizing and separating particles of a material using the improved dual-screen particle sizing apparatus is set forth below. Vibrator motor 5 is actuated and transmits a high frequency, high gravitational force, generally elliptical vibrating motion to frame 3 and attached screens 6. The gravitational force is generally within the range of 6 and 9 Gs. More specifically, the upper ends of screens 6a and 6b vibrate in a generally vertical elliptic motion as illustrated by arrow E in FIG. 3, and the lower ends of the screens also vibrate in a generally vertical elliptic motion as illustrated by arrows A and B, respectively.

A material to be processed such as kaolin clay indicated generally at 68, which is used as an additive in plastic and paper manufacturing, is supplied to inlet opening 66 of feed box 65. The clay 68 travels through the feed box and passes out of outlet openings 67a and 67b and onto the upper ends of vibrating screens 6a and 6b, respectively. The clay material then travels downwardly on screens 6, with undesirable larger size particles 69 remaining on the screens and dropping off the lower ends of the screens for removal. Desirable smaller size particles 70 pass downwardly through screens 6 and onto catch trays 59 of screen boxes 55 and out of chute 60, for further use in plastic or paper processing.

In accordance with one of the main features of the present invention, although single motor 5 economically transmits the necessary vibratory motion to screens 6 for sizing and separation of kaolin clay 68 or other materials, the generally vertical elliptical motion transmitted to each of the screens is in opposite directions as shown in FIG. 3 and described above. More particularly, the elliptic motion of screen 6a indicated by arrow A is concurrent to the downward slope of the screen and the direction of movement of the clay thereon. On the other hand, the elliptic motion of screen 6b indicated by arrow B is countercurrent to the downward slope of the screen and the direction of movement of the clay thereon. This condition causes the clay to travel faster down screen 6a than it does down screen 6b, which lowers the efficiency of the particle sizing operation. Therefore, spacer plates 46 are inserted between I-beams 12 and bottom spring pads 40 of the pair of suspension assemblies 4 adjacent to the lower end of screen 6a. This insertion of spacers decreases the slope of inclined angle iron 25 of frame 3 positioned below screen 6a, and increases the slope of inclined angle iron 25 positioned below screen 6b. Thus, the slope of screen 6a is decreased and the slope of screen 6b is increased which serves to generally equalize the rate of movement of the clay thereon which increases the efficiency of the particle sizing operation.

It is understood that materials other than kaolin clay can be sized and separated using the above-described apparatus and method, although the above apparatus and method is best-suited for use in sizing large volume materials in a relatively short period of time. It is important to note that depending on the material being sized and separated, the necessary slope of the screens is within the wide range of three degrees to sixty degrees. Thus, when it is desired to utilize particle sizing apparatus 1 in a different application requiring a different screen slope, screen boxes 55 merely are removed and replaced with screen boxes having the proper slope. Therefore, it can be seen that sizing apparatus 1 is a versatile apparatus which can be effectively used in many different particle sizing operations. Moreover, the manner of mounting the screens within the screen boxes enables the screens to be quickly and easily replaced if they are worn, or when the need for a different mesh screen arises such as when another material is being sized.

Also, the efficient four foot length of the screens still is long enough for use of water spray equipment and techniques in combination with the apparatus and method of the present invention, if necessary.

Figure 7:
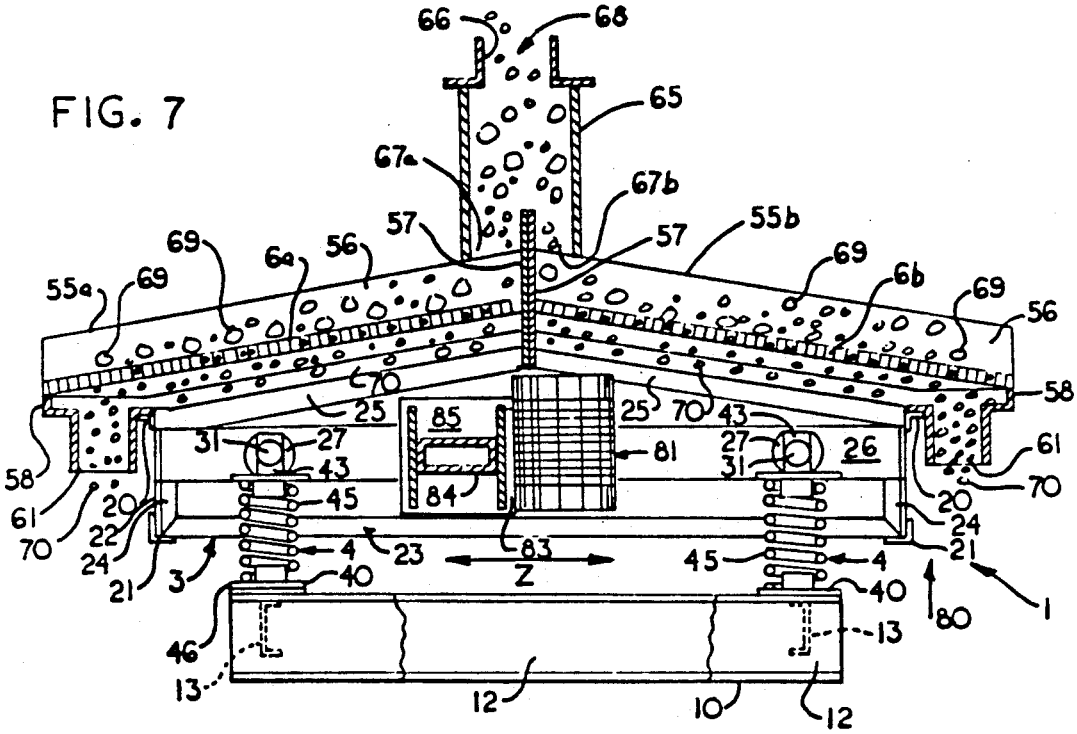
FIG. 7 is a sectional view similar to FIG. 3, with portions broken away, showing a second embodiment of the dual-screen particle sizing apparatus of the present invention having a pair of motors.
Figure 8:
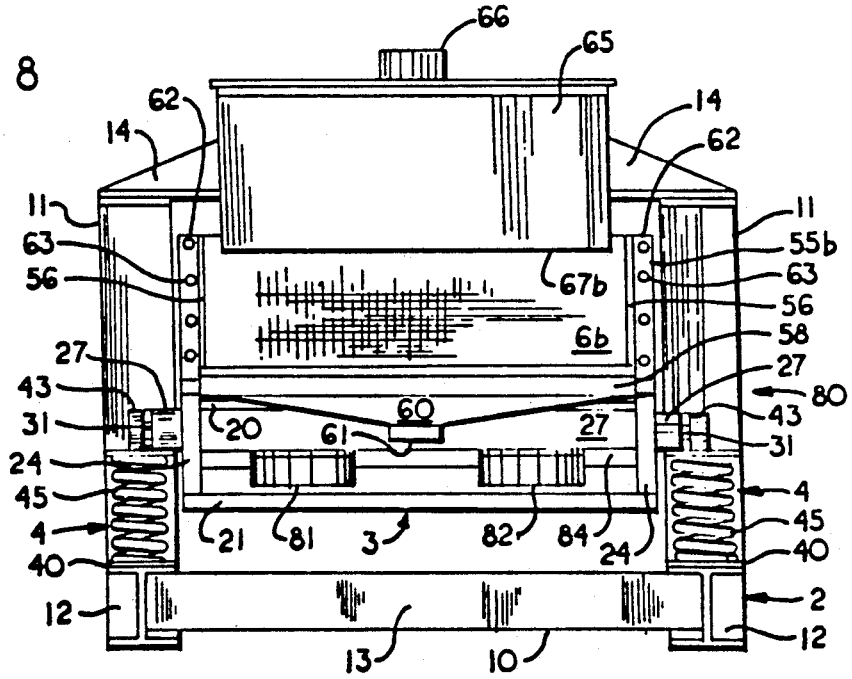
FIG. 8 is an elevational end view of the second embodiment shown in FIG. 7.

A second embodiment of the improved dual-screen particle sizing apparatus of the invention is indicated generally at 80, and is shown in FIGS. 7 and 8. Sizing apparatus 80 and the method in which it is used is similar to sizing apparatus 1 and method in most respects, except that apparatus 80 incorporates a pair of vibrator motors indicated generally at 81 and 82. Each motor 81 and 82 is mounted on a motor base member 83, which in turn is mounted on and extends outwardly of a transverse channel member 84 so that the shafts of the motors are positioned vertically and rotate in opposite directions. Channel member 84 extends between and is connected to an opposed pair of plates 85 which are attached to side channel support beams 26 of frame 3. Motors 81 and 82 are of synchronous frequency and each is similar to motor 5 of sizing apparatus 1 described above, but together transmit a high frequency, high gravitational force, generally horizontal linear vibrating motion to frame 2 through motor base members 83, channel member 84 and plates 85, as illustrated by double arrow Z in FIG. 8. Such a horizontal, linear or "back-and-forth" motion is desirable for applications where the material to be processed contains heavy, oversize solid particles 69 which tend to block screens 6 of sizing apparatus 80 and interfere with the passage of desirable smaller particles 70 therethrough. The horizontal linear motion transmitted to screens 6 causes the undesirable oversize particles 69 to move quickly along the top of the screens so that more screen area is available for passage of the desirable smaller particles 70.

A third embodiment of the dual-screen particle sizing apparatus is indicated generally at 90, and is shown in FIGS. 9 and 10. Sizing apparatus 90 and method also is similar to sizing apparatus 1 and the method in which it is used in most respects, except that apparatus 90 incorporates three vibrator motors indicated generally at 91, 92 and 93. Each motor 91-93 is mounted on a motor base member 94, which in turn is mounted on and extends outwardly of a transverse channel member 95 so that the shaft of motors 91 and 92 are positioned vertically and rotate in opposite directions, and the shaft of motor 93 is positioned horizontally, and extends transversely with respect to frame 3. Channel member 95 extends between and is connected to an opposed pair of plates 96 which are attached to side channel support beams 26 of frame 3. Motors 91-93 are of synchronous frequency and each is similar to motor 5 of sizing apparatus 1 described above, but together transmit a high frequency, high gravitational force, generally amplified inclined elliptical vibrating motion to frame 3 through motor base members 94, channel member 95 and plates 96, as illustrated by ellipses X and Y in FIG. 9. Still another motion, illustrated by dot-dash symbols C and D of FIG. 9, can be transmitted to frame 3 by generally doubling the frequency of motor 93 over that of motors 91 and 92. The result is the transmission of a high frequency, high gravitational force, generally amplified pulsating vibrating motion to frame 3. The motion illustrated by ellipses X and Y is desirable for processing sticky materials, and the motion illustrated by symbols C and D can be effectively used for operations requiring extremely accurate particle sizing.

Again, the main feature of the dual-screen particle sizing apparatus and method of the present invention is the manner in which a pair of screens each having a length of four feet are mounted on the vibrating frame, in contrast to prior art particle sizing apparatus which utilize a single screen having a length of eight feet. The four foot length of the dual screens provides sufficient length for sizing and separation of the material to occur, and substantially increases the throughput of the particle sizing operation over prior art apparatus.

Another important feature is the manner in which one or more economical motors provides the necessary vibratory motion to the screens to achieve efficient sizing and separation for different material applications, wherein spacers are used to make small adjustments to the slope of the screens for generally equalizing the rate of movement of a material down the screen to overcome the differences in rate caused by the vibratory motion of the motors in apparatus 1 and 90. Other important features include the manner in which the screen boxes can be replaced so that the sizing apparatus can be used in different applications requiring different slopes of the screens, and also the manner in which the screens can be quickly and easily replaced due to wear or when the application calls for a different mesh screen.

In summary, the dual-screen particle sizing apparatus and method of the present invention is durable in use and relatively inexpensive to manufacture, operate and maintain.

Accordingly the dual screen particle sizing apparatus and method is simplified, provides an effective, safe, inexpensive, and efficient apparatus and method which achieves all the enumerated objectives, provides for eliminating difficulties encountered with prior apparatus and methods, and solves problems and obtains new results in the art.

In the foregoing description, certain terms have been used for brevity, clearness and understanding; but no unnecessary limitations are to be implied therefrom beyond the requirements of the prior art, because such terms are used for descriptive purposes and are intended to be broadly construed.

Moreover, the description and illustration of the invention is by way of example, and the scope of the invention is not limited to the exact details shown or described.

Having now described the features, discoveries and principles of the invention, the manner in which the improved dual-screen particle sizing apparatus and method is constructed and used, the characteristics of the construction and method steps, and the advantageous, new and useful results obtained; the new and useful structures, devices, elements, arrangements, parts and combinations, are set forth in the appended claims.

I claim:

1. An apparatus for sizing and separating particles of a material, said apparatus including:

a) a stand;

b) a frame having a pair of ends and an intermediate portion;

c) means attached to the stand and the frame for movably suspending the frame on the stand;

d) motor means mounted on the frame for vibrating said frame with a generally horizontal, linear vibrating motion; and e) a pair of laterally disposed inclined screens mounted on the frame, said screens each sloping downwardly from the intermediate portion of the frame toward a respective one of the ends of said frame, so that upon actuating the motor means and supplying a material onto upper ends of the screens, the vibrating frame vibrates the attached screens with a generally horizontal, linear vibrating motion, whereby said screens size and separate particles of the material as the particles move along the screens toward the ends of the frame.

2. The apparatus defined in claim 1 in which the means attached to the stand and the frame for movably suspending the frame on the stand is a pair of coil spring suspension assemblies mounted in a spaced relationship on the stand adjacent to each of tne pair of ends of the frame.

3. The apparatus defined in claim 2 in which a pair of spacers are insertable between the stand and a certain one of the pairs of suspension assemblies, for adjusting the incline of the screens to generally equalize the rate of movement of a material on each of the screens.

4. The apparatus defined in claim 1 in which each of the screens is removably mounted in a screen box which is removably mounted on the frame; and in which each of the screen boxes includes a catch tray located below the screen for receiving and guiding sized particles passing through said screen to a location remote from particles which do not pass through the screen.

5. The apparatus defined in claim 1 in which each of the screens is positioned on the frame at an incline generally between 3 degrees and 60 degrees; in which each of the screens measures approximately 4 feet by 4 feet; and in which the mesh of the screens generally is between 4 and 500 openings per linear inch.

6. An apparatus for sizing and separating particles of a material, said apparatus including:

a) a stand;

b) a frame having a pair of ends and an intermediate portion;

c) means attached to the stand and the frame for movably suspending the frame on the stand;

d) a pair of motors mounted on and beneath the intermediate portion of said frame, the motor shafts being positioned vertically and rotating in opposite directions, said motors having synchronous frequencies and transmitting a high frequency, high gravitational force, generally horizontal, linear vibrating motion to said frame: and e) a pair of inclined screens mounted on said frame, said screens each sloping downwardly from the intermediate portion of said frame toward a respective one of the ends of said frame, so that upon actuating said motors and supplying a material onto upper ends of said screens, the vibrating frame vibrates the attached screens with a high frequency, high gravitational force, generally horizontal, linear vibrating motion, whereby said screens size and separate particles of the material.

7. The apparatus defined in claim 6 in which the means attached to the stand and the frame for movably suspending the frame on the stand is a pair of coil spring suspension assemblies mounted in a spaced relationship on the stand adjacent to each of the pair of ends of the frame.

8. The apparatus defined in claim 7 in which a pair of spacers are insertable between the stand and a certain one of the pairs of suspension assemblies, for adjusting the incline of the screens to generally equalize the rate of movement of a material on each of the screens.

9. The apparatus defined in claim 6 in which each of the screens is removably mounted in a screen box which is removably mounted on the frame; and in which each of the screen boxes includes a catch tray located below the screen for receiving and guiding sized particles passing through said screen to a location remote from particles which do not pass through the screen.

10. The apparatus defined in claim 6 in which each of the screens is positioned on the frame at an incline generally between 3 degrees and 60 degrees; in which each of the screens measures approximately 4 feet by 4 feet; and in which the mesh of the screens generally is between 4 and 500 openings per linear inch.

11. The apparatus defined in claim 6 in which the frame is generally rectangular-shaped.

12. The apparatus defined in claim 6 in which the stand comprises a base portion and a pair of spaced, parallel vertically extending pillars.

13. The apparatus defined in claim 12 in which a feed box is mounted on the pillars of the stand adjacent to and above the upper ends of the screens.

14. A method of sizing and separating particles of a material, using an apparatus comprising a stand, a frame having a pair of ends and an intermediate portion, suspension means attached to the stand and the frame for movably suspending the frame on the stand, motor means mounted on the frame for vibrating said frame, and a pair of inclined screens mounted on the frame, said screens each sloping downwardly from the intermediate portion of the frame toward a respective one of the ends of said frame, said method including the steps of:

a) actuating the motor means;

b) vibrating the frame and attached screens with a vibrating motion transmitted to the frame by the motor means;

c) supplying a material onto upper ends of the vibrating screens;

d) sizing and separating particles of the material as the particles move along the screens toward the ends of the frame; and e) adjusting the slope of the screens for offsetting said vibrating motion transmitted in generally opposite directions to said respective screens through said frame due to the direction of drive of said motor means, and generally equalizing the rate of movement of a material on each of the screens.

15. The method defined in claim 14 including the step of vibrating the frame and attached screens with a high frequency, high gravitational force, generally vertical elliptical vibrating motion transmitted to the frame by the motor means.

16. The method defined in claim 14 including the step of vibrating the frame and attached screens with a high frequency, high gravitational force, generally horizontal, linear vibrating motion transmitted to the frame by the motor means.

17. The method defined in claim 14 including the step of vibrating the frame and attached screens with a high frequency, high gravitational force, generally amplified inclined elliptical vibrating motion to the frame and attached screens.

18. The method defined in claim 14 including the step of vibrating the frame and attached screens with a high frequency, high gravitational force, generally amplified pulsating vibrating motion to the frame and attached screens.

19. The method defined in claim 14 in which adjusting the slope of the screens includes the step of inserting spacer means between the stand and the suspension means for decreasing the slope of a certain one of the screens having a downward slope generally concurrent to the direction of vibration of the motor means, and increasing the slope of the other of the screens having a downward slope generally countercurrent to the direction of vibration of the motor means.

20. The method defined in claim 14 including the step of replacing the screens for changing the slope of the screens mounted on the frame within the approximate range of 3 degrees and 60 degrees.

21. An apparatus for sizing and separating particles of a material, said apparatus including:

a) a stand;

b) a frame having a pair of ends and an intermediate portion;

c) means attached to the stand and the frame for movably suspending the frame on the stand;

d) a motor mounted on and beneath the intermediate portion of said frame, with the shaft of said motor being positioned horizontally and extending transversely with respect to said frame, said motor transmitting a high frequency, high gravitational force, generally vertical elliptical vibrating motion to said frame; and e) a pair of inclined screens mounted on said frame, said screens each sloping downwardly from the intermediate portion of said frame toward a respective one of the ends of said frame, so that upon actuating said motor and supplying a material onto upper ends of said screens, the vibrating frame vibrates the attached screens with a high frequency, high gravitational force, generally vertical elliptical vibrating motion, whereby said screens size and separate particles of the material.

22. An apparatus for sizing and separating particles of a material, said apparatus including:

a) a stand;

b) a frame having a pair of ends and an intermediate portion;

c) means attached to the stand and the frame for movably suspending the frame on the stand;

d) a plurality of motors comprising first, second and third motors mounted on and beneath the intermediate portion of said frame, with the shafts of said first and second motors being positioned vertically and rotating in opposite directions, and the shaft of said third motor being positioned horizontally and extending transversely with respect to said frame, said first and second motors having synchronous frequencies and said third motor having a frequency generally double the frequency of said first and second motors, said motors transmitting a high frequency, high gravitational force, generally amplified pulsating vibrating motion to said frame; and e) a pair of inclined screens mounted on said frame, said screens each sloping downwardly from the intermediate portion of said frame toward a respective one of the ends of said frame, so that upon actuating said motors and supplying a material onto upper ends of said screens, the vibrating frame vibrates the attached screens with a high frequency, high gravitational force, generally amplified pulsating vibrating motion, whereby said screens size and separate particles of the material.

23. An apparatus for sizing and separating particles of a material, said apparatus including:

a) a stand;

b) a frame having a pair of ends and an intermediate portion;

c) means attached to the stand and the frame for movably suspending the frame on the stand;

d) a pair of motors mounted on and beneath the intermediate portion of said frame, with the shafts of said motors being positioned vertically and rotating in opposite directions, said motors having synchronous frequencies and transmitting a high frequency, high gravitational force, generally horizontal, linear vibrating motion to said frame; and e) a pair of inclined screens mounted on said frame, said screens each sloping downwardly from the intermediate portion of said frame toward a respective one of the ends of said frame, so that upon actuating said motors and supplying a material onto upper ends of said screens, the vibrating frame vibrates the attached screens with a high frequency, high gravitational force, generally horizontal, linear vibrating. motion, whereby said screens size and separate particles of the material as the particles move along the screens toward the ends of the frame.

24. An apparatus for sizing and separating particles of a material, said apparatus including:

a) a stand;

b) a frame having a pair of ends and an intermediate portion;

c) means attached to the stand and the frame for movably suspending the frame on the stand;

d) a motor mounted on and beneath the intermediate portion of said frame, with the shaft of said motor being positioned horizontally and extending transversely with respect to said frame, said motor transmitting a high frequency, high gravitational force, generally vertical elliptic vibrating motion to said frame; and e) a pair of inclined screens mounted on said frame, said screens each sloping downwardly from the intermediate portion of said frame toward a respective one of the ends of said frame, so that upon actuating said motor and supplying a material onto upper ends of said screens, the vibrating frame vibrates the attached screens with a high frequency, high gravitational force, generally vertical elliptic vibrating motion, whereby said screens size and separate particles of the material as the particles move along the screens toward the ends of the frame.

25. An apparatus for sizing and separating particles of the material, said apparatus including:

a) a stand;

b) a frame having a pair of ends and an intermediate portion;

c) means attached to the stand and the frame for movably suspending the frame on the stand;

d) a plurality of motors comprising first, second and third motors mounted on and beneath the intermediate portion of said frame, with the shafts of said first and second motors being positioned vertically and rotating in opposite directions, and the shaft of said third motor being positioned horizontally and extending transversely with respect to said frame, said first and second motors having synchronous frequencies and said third motor having a frequency generally double the frequency of said first and second motors, said motors transmitting a high frequency, high gravitational force, generally amplified pulsating vibrating motion to said frame; and e) a pair of inclined screens mounted on said frame, said screens each sloping downwardly from the intermediate portion of said frame toward a respective one of the ends of said frame, so that upon actuating said motors and supplying a material onto upper ends of said screens, the vibrating frame vibrates the attached screens with a high frequency, high gravitational force, generally amplified pulsating vibrating motion, whereby said screens size and separate particles of the material as the particles move along the screens toward the ends of the frame.

26. A method of sizing and separating particles of a material, using an apparatus comprising a stand, a frame having a pair of ends and an intermediate portion, suspension means attached to the stand and the frame for movably suspending the frame on the stand, motor means mounted on the frame for vibrating said frame, and a pair of inclined screens mounted on the frame, said screens each sloping downwardly from the intermediate portion of the frame toward a respective one of the ends of said frame, said method including the steps of:

a) actuating the motor means;

b) vibrating the frame and attached screens with a high frequency, high gravitational force, generally horizontal, linear vibrating motion transmitted to the frame by the motor means;

c) supplying a material onto upper ends of the vibrating screens;

d) sizing and separating particles of the material as the particles move along the screens toward the ends of the frame; and e) adjusting the slope of the screens for generally equalizing the rate of movement of a material on each of the screens.

27. A method of sizing and separating particles of a material, using an apparatus comprising a stand, a frame having a pair of ends and an intermediate portion, suspension means attached to the stand and the frame for movably suspending the frame on the stand, motor means mounted on the frame for vibrating said frame, and a pair of inclined screens mounted on the frame, said screens each sloping downwardly from the intermediate portion of the frame toward a respective one of the ends of said frame, said method including the steps of:

a) actuating the motor means;

b) vibrating the frame and attached screens with a high frequency, high gravitational force, generally vertical elliptical vibrating motion transmitted to the frame by the motor means;

c) supplying a material onto upper ends of the vibrating screens;

d) sizing and separating particles of the material as the particles move along the screens toward the ends of the frame; and e) adjusting the slope of the screens for generally equalizing the rate of movement of a material on each of the screens.

28. A method of sizing and separating particles of a material, using an apparatus comprising a stand, a frame having a pair of ends and an intermediate portion, suspension means attached to the stand and the frame for movably suspending the frame on the stand, motor means mounted on the frame for vibrating said frame, and a pair of inclined screens mounted on the frame, said screens each sloping downwardly from the intermediate portion of the frame toward a respective one of the ends of said frame, said method including the steps of:

a) actuating the motor means;

b) vibrating the frame and attached screens with a high frequency, high gravitational force, generally amplified pulsating vibrating motion transmitted to the frame by the motor means;

c) supplying a material onto upper ends of the vibrating screens;

d) sizing and separating particles of the material as the particles move along the screens toward the ends of the frame;

e) adjusting the slope of the screens for generally equalizing the rate of movement of a material on each of the screens.

29. An apparatus for sizing and separating particles of a material, said apparatus including:

a) a stand;

b) a frame having a pair of ends and an intermediate portion;

c) means attached to the stand and the frame for movably suspending the frame on the stand;

d) motor means mounted on the frame for vibrating said frame with a generally vertical elliptical vibrating motion; and e) a pair of laterally disposed inclined screens mounted on the frame, said screens each sloping downwardly from the intermediate portion of the frame toward a respective one of the ends of said frame, so that upon actuating the motor means and supplying a material onto upper ends of the screens, the vibrating frame vibrates the attached screens with a generally vertical elliptical vibrating motion, whereby said screens size and separate particles of the material as the particles move along the screens toward the ends of the frame.

30. An apparatus for sizing and separating particles of a material, said apparatus including:

a) a stand;

b) a frame having a pair of ends and an intermediate portion;

c) means attached to the stand and the frame for movably suspending the frame on the stand;

d) motor means mounted on the frame for vibrating said frame with a generally amplified pulsating vibrating motion; and e) a pair of laterally disposed inclined screens mounted on the frame, said screens each sloping downwardly from the intermediate portion of the frame toward a respective one of the ends of said frame, so that upon actuating the motor means and supplying a material onto upper ends of the screens, the vibrating frame vibrates the attached screens with a generally amplified pulsating vibrating motion, whereby said screens size and separate particles of the material as the particles move along the screens toward the ends of the frame.

* * * * *